US006748661B2

(12) United States Patent
Hawk

(10) Patent No.: US 6,748,661 B2
(45) Date of Patent: Jun. 15, 2004

(54) "SHOCKING ABSORBING" BLADE STOP FOR A FOLDING KNIFE

(76) Inventor: Grant Woodrow Hawk, Box 401, Idaho City, ID (US) 83631

( * ) Notice: Subject to any disclaimer, the term of this patent is extended or adjusted under 35 U.S.C. 154(b) by 0 days.

(21) Appl. No.: 10/109,455

(22) Filed: Mar. 27, 2002

(65) Prior Publication Data

US 2003/0182804 A1 Oct. 2, 2003

(51) Int. Cl.[7] ..... B26B 1/02
(52) U.S. Cl. ..... 30/155; 30/158; 30/271
(58) Field of Search ..... 30/155, 158, 271, 30/159, 156, 157, 152, 331; 81/177.6, 177.7

(56) References Cited

U.S. PATENT DOCUMENTS 3,882,599 A * 5/1975 Plum ..... 302/71 X
6,105,255 A * 8/2000 Cheng ..... 30/155 X

* cited by examiner

*Primary Examiner*—Douglas D. Watts

(57) ABSTRACT

A shock absorbing blade stop for a folding knife comprising; an elongated, cylinder shaped body, with o-ring grooves provided near its opposite ends. O-rings of a resilient material affixed to the o-ring grooves and the completed assembly located within the handle frames of a folding knife by means of location holes provided in the handle frames for that purpose. Location holes are of an inside diameter closely corresponding to the outside diameter of the mounted o-rings thereby producing a shock absorbing effect in response to the impact of a fast opening blade colliding against the blade stop. An enlarged center section of the blade stop is provided with an increased diameter slightly larger than the locating holes of the handle frames so as to capture the blade stop within the space between handle frames.

4 Claims, 2 Drawing Sheets

"SHOCKING ABSORBING" BLADE STOP FOR A FOLDING KNIFE

BACKGROUND

1. Field of Invention

This invention relates to folding knives, specifically to an improved method of stopping the opening blade of such knives.

2. Description of Prior Art

The evolution of the folding knife, and its related mechanisms, has made dramatic improvements in recent years. Custom knife makers, such as myself, have developed numerous innovations aimed at overcoming the inherent weaknesses of a knife that folds into itself.

The two main advantages of a folding knife, as opposed to a fixed blade knife, are that it can be reduced to a more compact configuration for comfortable carry and it does not require a separate sheath to protect the user from the sharp edge.

The main disadvantages of a folding knife, as compared to a fixed blade knives, are as follows:

(a) A folding knife, being constructed of multiple moving parts, can never be made quite as strong or quite as reliable as a fixed blade knife.

(b) A folding knife poses a greater danger to the user than mere breakage because a mechanical malfunction may allow the sharp blade to close on the fingers.

(c) A folding knife is much slower to deploy in an emergency because of the additional and necessary step of opening the blade before using.

The direction that the evolution of folding knife design has taken is that of attempting to solve the inherent shortcomings of folding knives as compared to the fixed blade knife. Custom knife makers and factory knife designers everywhere are hard at work in an attempt to make folding knives stronger, safer and faster. There exists a vast body of prior art related to folding knife design, most of which is directly aimed at solving one or more of these three primary weakness.

A recent trend has been to build folding knives of heavier stronger components while at the same time developing mechanisms that allow for a very fast opening of the blade.

This new trend has generated a new problem in that a heavier faster opening blade has the effect of greatly increasing the impact upon the blade stop. The result of this condition is that makers are experiencing high failure rates for locking mechanisms, blade stops and the surfaces that locate the blade stop.

OBJECTS AND ADVANTAGES

Accordingly, the object of my invention is to solve the problems associated with the use of the heavier, faster opening blades of modern folding knife design.

The "shock absorbing" blade stop offers a simple elegant solution to a difficult problem through the use of easily made components, such as a lathe turned blade stop provided with o-ring grooves and easily available components such as commercially made o-rings. O-rings are made in a wide variety of sizes and materials. Urethane which is among the most durable and therefore the more desirable of the readily attainable materials is also available in a variety of durometers ranging from hard to soft so that correct combinations are easily achieved.

The chief advantage of the shock absorbing blade stop is to dramatically reduce the wear and deformation of the blade stop, pivot pin, and locking mechanism of a folding knife, when that folding knife is subject to the abuse associated with hard and fast opening of a heavy blade.

DRAWING FIGURES

In the drawings, closely related figures have the same number but different alphabetic suffixes.

Figure 1A:
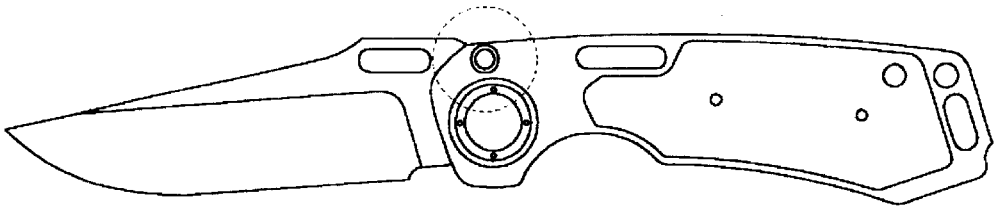
FIG. 1A shows, a complete folding knife with a typical location for the blade stop encircled.

| Reference Numerals In Drawings | |
|---|---|
| 10 blade stop | 12 o-rings |
| 14 enlarged diameter | 16A handle frame |
| 16B handle frame | 18 blade |
| 22 locating holes | 20 allowance for travel |
| 24 o-ring grooves | |

DESCRIPTION—FIGS. 1 TO 3

Figure 1B:
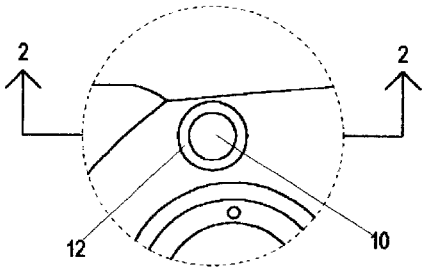
FIG. 1B shows an enlarged view of the encircled area containing the blade stop with cross section lines indicating the view shown in FIG. 2.
Figure 2:
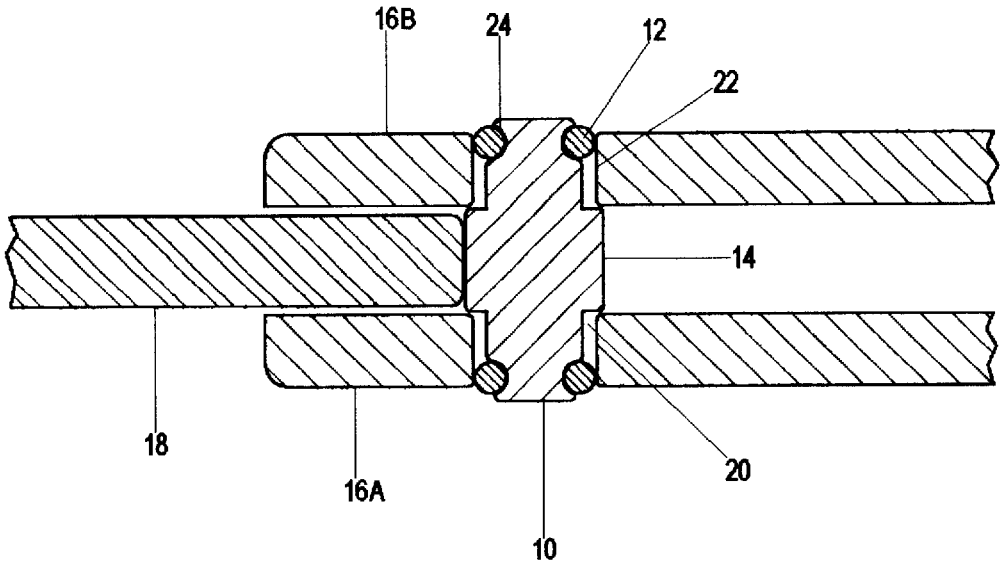
FIG. 2 shows a cross section of that area containing the blade stop, including blade, blade stop body, o-rings and handle frames
Figure 3:
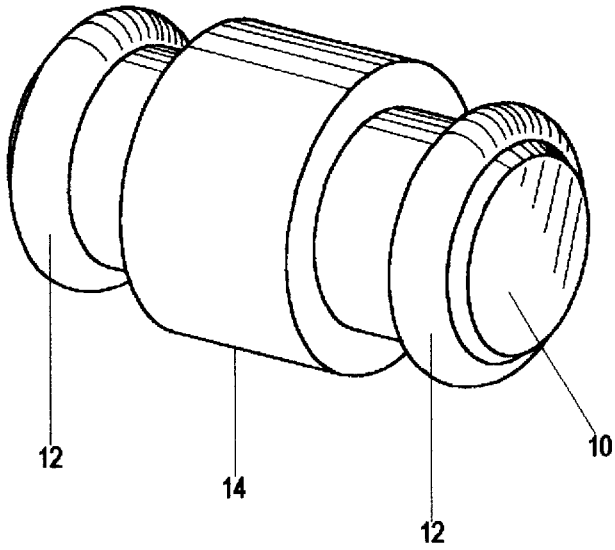
FIG. 3 shows a perspective view of the stop body with o-rings attached.

A typical embodiment of the "shock absorbing" blade stop of the present invention is shown at the figures listed below. FIG. 1A show a folding knife with the area encircled containing a typical location for a blade stop 10, FIG. 1B shows an enlarged view of the same area with a cross section line delineating the cross sectional view of FIG. 2. FIG. 2 shows a blade 18 in its open position at rest against the blade stop 10. Blade stop 10 is shown inserted into the handle frames 16A and 16B by means of the holes 22 provided in handle frames 16A and 16B for that purpose. Blade stop 10 is shown captured between handle frames 16A and 16B by reason of the enlarged diameter 14 of blade stop 10 being of a somewhat larger diameter than the locating holes 22 of handle frames 16A and 16B. O-rings 12 are shown contained within o-ring grooves 24 of blade stop 10 and in contact with the inside diameter of locating holes 22 provided within handle frames 16A and 16B. An allowance for travel 20 is also shown between the blade stop 10 and the inside diameter of locating holes 22 of handle frames 16A and 16B. FIG. 3 is a perspective view of blade stop with o-rings in place.

Operation—FIGS. 1 to 3

In operation, movement is initiated by the opening of blade 18 FIG. 2 which impacts blade stop 10 causing it to move within the confines of allowance for travel 20 restrained only by the degree of resiliency contained within the material of o-rings 12. The resiliency of o-rings 12 has the effect of absorbing the shock of the opening blade 18 as it impacts the blade stop 10.

SUMMARY

In accordance with the present invention, a "shock absorbing" blade stop, of an elongated cylindrical configuration, provided with o-ring grooves and o-rings near its end points and located by holes bored in the handle frames of a folding knife.

Conclusion, Ramification, and Scope

Thus the reader will see that the blade stop of the present invention provides a simple, reliable, yet economical solution to the emerging problem of premature wear and or damage to a folding knife of fast opening, heavily constructed, modern design.

While my above description contains many specificities, these should not be construed as limitations on the scope of the invention, but rather as an exemplification of one preferred embodiment thereof. Many other variations are possible, for example, instead of O-rings, other shapes of resilient materials or even springs could be used to produce the same effect. In addition blade stops are sometimes installed on the blade instead of the handle frames which would only require a reconfiguration of the principle elements of this invention.

What is claimed is:

1. A shock absorbing blade stop for a folding knife, comprising;

(a) a blade stop of sufficient size and substance to provide a reliable stopping point for the opening blade of a folding knife, (b) a resilient component, selected from the group containing elastomers and springs, configured and positioned to occupy a predetermined space between said blade stop and that portion of said knife to which it is adjoined, whereby said blade stop is allowed some predetermined measure of travel, restrained primarily by the degree of resiliency contained within said resilient component, wherein the blade stop is configured to the shape of an elongated cylinder provided with o-ring grooves cut near its opposite ends surrounding the circumference.

2. The blade stop of claim 1 wherein o-rings made of a resilient material are affixed to the o-ring grooves provided at each of the opposite end, of the blade stop.

3. The blade stop of claim 2 wherein the stop body together with it's attached o-rings is captured within the handle frames by holes provided in said handle frames for that purpose, said holes being of an inside diameter essentially conforming to the outside diameter of said o-rings.

4. The blade stop of claim 3 wherein the blade stop is provided with a centrally located enlarged diameter of a dimension slightly larger than the locating holes in the handle frames, whereby said blade stop is securely contained between said handle frames but free to travel at right angles to its long axis, retrained only by the resiliently of the material from which the o-rings are made.

* * * * *